US012799705B2

(12) United States Patent
Hornstein

(10) Patent No.: US 12,799,705 B2
(45) Date of Patent: Nov. 17, 2026

(54) CONTROLLER FOR AN EXCAVATOR FOR ACTUATING A WORKING DEVICE

(71) Applicant: Kiesel Technology GmbH, Baienfurt (DE)

(72) Inventor: Felix Hornstein, Mainz (DE)

(73) Assignee: KIESEL TECHNOLOGY GMBH, Baienfurt (DE)

( * ) Notice: Subject to any disclaimer, the term of this patent is extended or adjusted under 35 U.S.C. 154(b) by 0 days.

(21) Appl. No.: 19/135,322

(22) PCT Filed: Nov. 13, 2023

(86) PCT No.: PCT/IB2023/061429

§ 371 (c)(1),
(2) Date: Jun. 3, 2025

(87) PCT Pub. No.: WO2024/121654

PCT Pub. Date: Jun. 13, 2024

(65) Prior Publication Data

US 2026/0193861 A1 Jul. 9, 2026

(30) Foreign Application Priority Data

Dec. 9, 2022 (DE) ..... 10 2022 132 870.8

(51) Int. Cl.

| | |
|---|---|
| ***E02F 3/43*** | (2006.01) |
| ***E02F 3/36*** | (2006.01) |
| ***E02F 9/20*** | (2006.01) |
| ***E02F 9/22*** | (2006.01) |
| ***E02F 9/26*** | (2006.01) |

(52) U.S. Cl.
CPC ..... *E02F 3/435* (2013.01); *E02F 3/3681* (2013.01); *E02F 9/2004* (2013.01); *E02F 9/265* (2013.01); *E02F 9/2203* (2013.01); *E02F 9/2285* (2013.01)

(58) Field of Classification Search
None
See application file for complete search history.

(56) References Cited

U.S. PATENT DOCUMENTS 6,643,577 B1 11/2003 Padgett et al.
7,681,686 B1 3/2010 Klas et al.
(Continued)

FOREIGN PATENT DOCUMENTS

CN 111794298 A 10/2020
DE 202009017388 U1 * 5/2011 ..... E02F 9/2858
(Continued)

*Primary Examiner* — Jennifer M Anda
(74) *Attorney, Agent, or Firm* — KRIEGSMAN & KRIEGSMAN

(57) ABSTRACT

Control system for an excavator for actuating a working device having a one-hand operating device, which is controlled by a working device, connected to an attachment device, which comprises a rotary drive. A control circuit controls at least one rotary movement of the working device as a function of its control by a handle. Control system for an excavator for actuating a working device having a one-hand operating device, which is controlled by a working device, connected to an attachment device, which comprises a rotary drive. A control circuit controls at least one rotary movement of the working device as a function of its control by a handle.

13 Claims, 4 Drawing Sheets

(56) References Cited

U.S. PATENT DOCUMENTS

Figure 1:
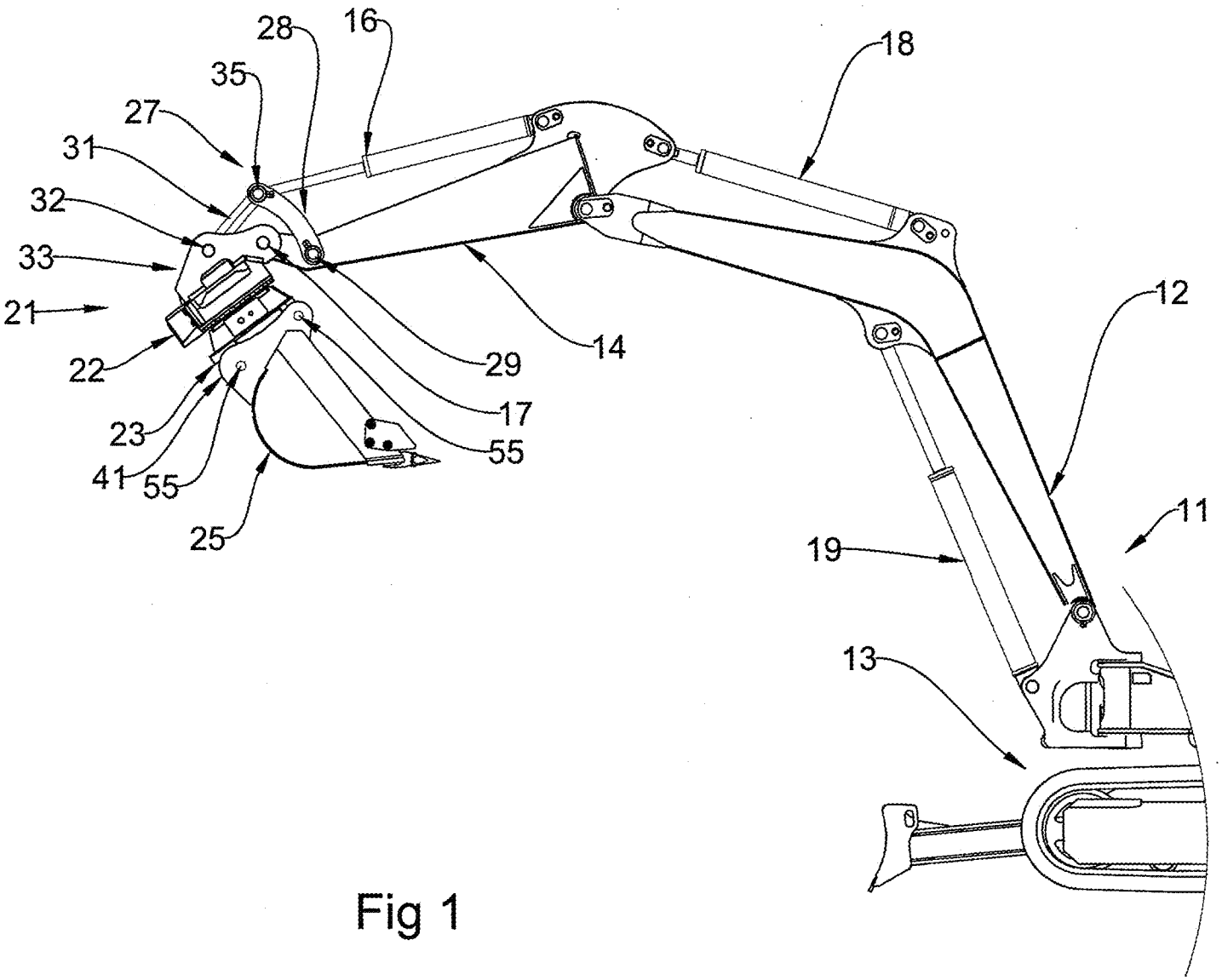

| | | | | |
|---|---|---|---|---|
| 2009/0158625 | A1* | 6/2009 | Pope | E02F 3/3681 700/213 |
| 2011/0150617 | A1* | 6/2011 | Harter | E02F 3/3677 414/722 |
| 2011/0264336 | A1 | 10/2011 | Bengtsson | |
| 2016/0145832 | A1* | 5/2016 | Stockhaus | E02F 3/32 414/815 |
| 2020/0318316 | A1* | 10/2020 | Kjaergaard | E02F 9/2037 |
| 2021/0002853 | A1* | 1/2021 | Yamashita | E02F 9/2203 |
| 2021/0095441 | A1* | 4/2021 | Jonsson | E02F 3/3681 |
| 2022/0106767 | A1 | 4/2022 | Viergutz et al. | |

FOREIGN PATENT DOCUMENTS

| | | | |
|---|---|---|---|
| DE | 202011003220 | U1 | 9/2011 |
| DE | 202021101016 | U1 | 2/2022 |
| JP | S62016154 | U | 1/1987 |
| JP | 2000204602 | A | 7/2000 |
| WO | 2014209209 | A1 | 12/2014 |
| WO | 2019187659 | A1 | 10/2019 |

* cited by examiner

CONTROLLER FOR AN EXCAVATOR FOR ACTUATING A WORKING DEVICE

The invention relates to a control system for an excavator for actuating a working device.

In excavators, it is known to control a working device, such as a bucket, for digging in the ground by means of a one-hand operating device. This allows the working device to be moved relative to a handle of the excavator. The working device can also be moved into a desired position by controlling a movement of the handle.

With the previous excavators, a swivel movement of the working device is controlled by an actuating direction assigned to this swivel movement on a handle of the one-hand operating device. When connected to an attachment device, the working device can be rotated 360° at any angle by the attachment device. This can result in the alignment of the working device in two successive working positions being offset by 180°, for example. Such a change in the working position of the working device requires the operator of the one-hand operating device to change and adapt the operating direction of the handle according to the orientation of the working device.

The invention is based on the task of providing a control system for an excavator for controlling an attachment, which makes it possible for the operator to carry out the same actuating direction on a handle of the one-hand operating device to actuate a working movement of the attachment, regardless of the orientation of the attachment.

This task is solved by a control system for an excavator for actuating a working device, in which at least one angle detection device is provided for detecting an angular position of the working device relative to an attachment device, which is controlled by a rotary movement of the working device about the axis of rotation by the rotary drive, which communicates with a control circuit, and in that in the event of a change in the orientation of the working device by a rotary movement about the axis of rotation from a first working range into a second working range or vice versa, which can be detected by the angle detection device, a change in the actuation of a pivoting direction of the attachment device can be actuated by the control circuit with the same actuating device direction of the handle of the one-hand operating device.

This simplifies the operation of the working device for the excavator operator. It is not necessary to adjust the actuating direction of the handle of the one-hand operating device to control a functional movement or working movement of the working device depending on its orientation. This also enables simplified and fast handling and thus execution of the work at hand.

Advantageously, it is provided that the first and second working areas together extend over a circumference of 360°. This means that the entire possible range of rotation for aligning the working device around an axis of rotation of the attachment device can be covered.

It is preferable that the first and second working ranges are equal in circumference and preferably have an angle of 180°. This makes it easy to divide the entire rotation range by 360°.

In particular, it is provided that a dividing line between the first and the second working area is formed in the mounting axis or parallel to the mounting axis of the attachment device, about which the attachment device is pivotably mounted on the stick of the excavator. The first working area can, for example, be aligned in the opposite direction to the extension of the stick. The second working area can, for example, extend in the direction of the stick. If a bucket with a tool is provided as a working device and the tool of the bucket enters the second working area with an attachment facing the underside of the stick, the bucket can be used as a so-called backhoe bucket. If the working device is swiveled by 180°, for example, and the bucket tool is provided with an attachment device swiveled towards the underside of the handle, the working device tool points into the first working area. This means that the working device can be used as an elevating bucket. These two different angular positions are detected by the angle detection device and a signal is sent to the control circuit in each case. The change between the two working ranges is processed by the control circuit and a change is made in the control of the swivel movement of the attachment around the handle with the same actuation direction of the handle for the control of a working movement of the working device. The operator can control the digging movement regardless of the orientation of the working device when the direction of actuation of the handle of the one-hand operating device for digging is known to him. It is not necessary to rethink the actuation of the one-hand operating device depending on the orientation of the working device.

Preferably, the control circuit comprises a control block from which a rotary drive of the attachment for controlling the rotary movement of the working device can be controlled hydraulically or electrically with a control circuit. The rotary drive can comprise both a hydraulically and electrically driven motor. The control signals are output from the control block accordingly.

Furthermore, it is preferable that the control block of the control circuit hydraulically or electrically controls at least one working cylinder for actuating the swivel movement of the attachment device about the mounting axis on the handle with a control circuit.

Furthermore, it is preferable that the control block of the control circuit can be controlled hydraulically or electrically by the one-hand operating device with a further control circuit.

Advantageously, the control circuit provided between the one-hand operating device and the control block can be hydraulic and operate with a pilot pressure. This pilot pressure is, for example, considerably lower than a working pressure, provided that the swivel movement of the attachment device and/or the rotary movement of the rotary drive is hydraulically controlled by the control block. This hydraulic control circuit between the one-hand operating device and the control block has the advantage that feedback can be provided to the handle of the one-hand operating device during the control of a working movement of the working device, so that the operator can feel whether, for example, the working device is running on block or encounters increased resistance during the control of a working movement.

The at least one angle detection device is advantageously designed as an angle encoder, position encoder, encoder or the like.

Figure 2:
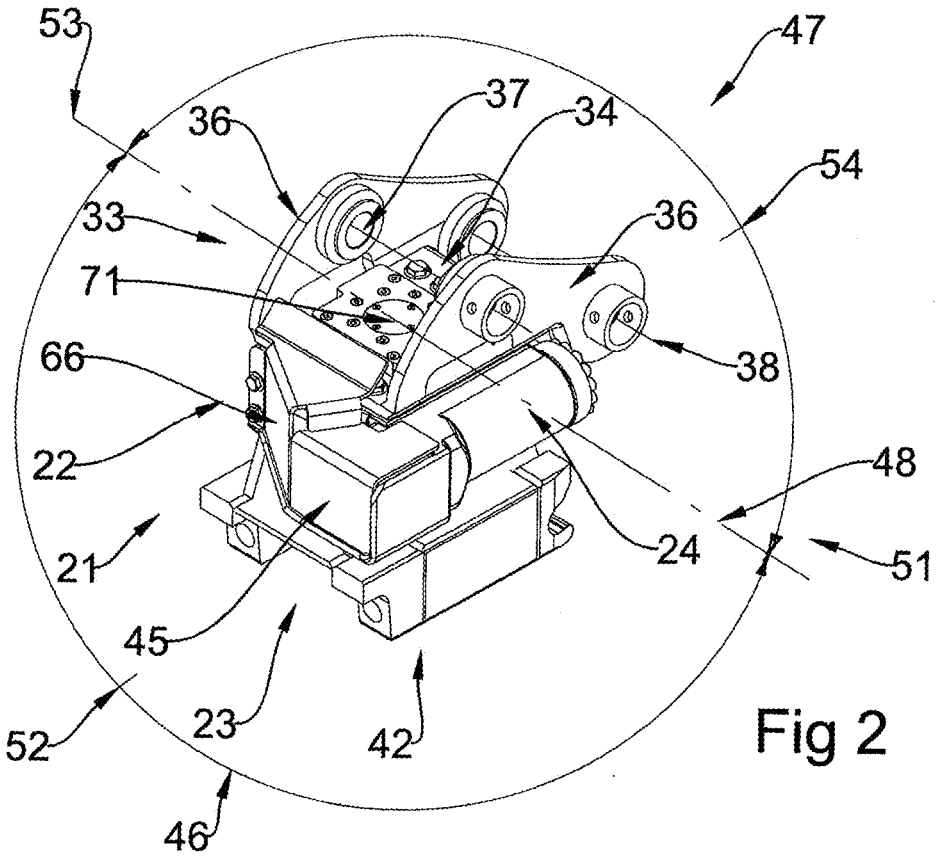
Figure 3:
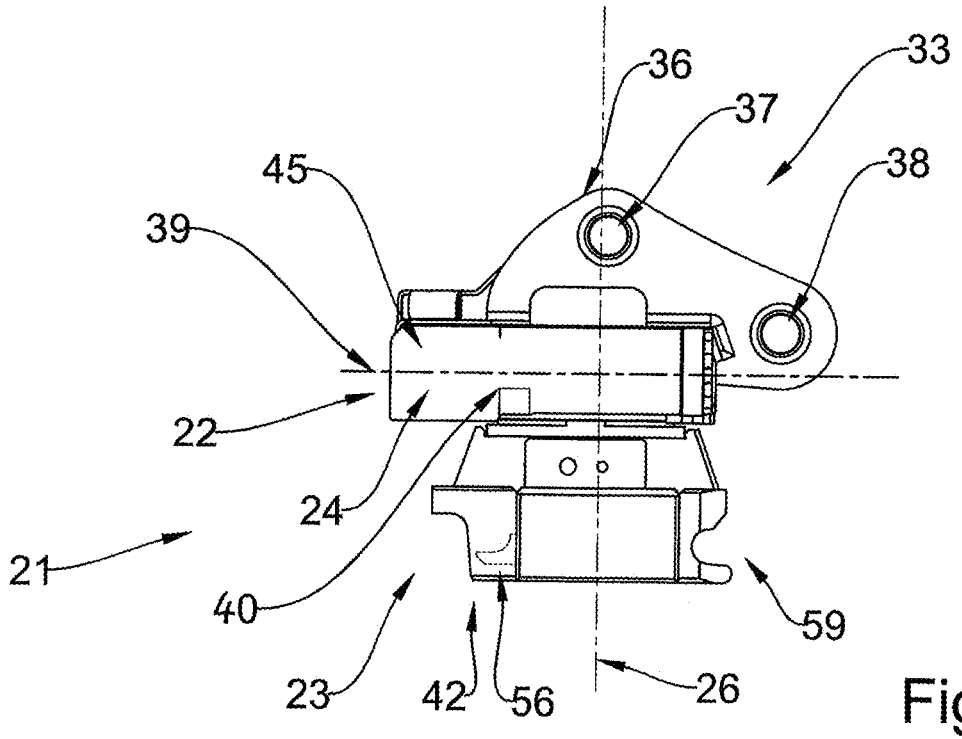
Figure 4:
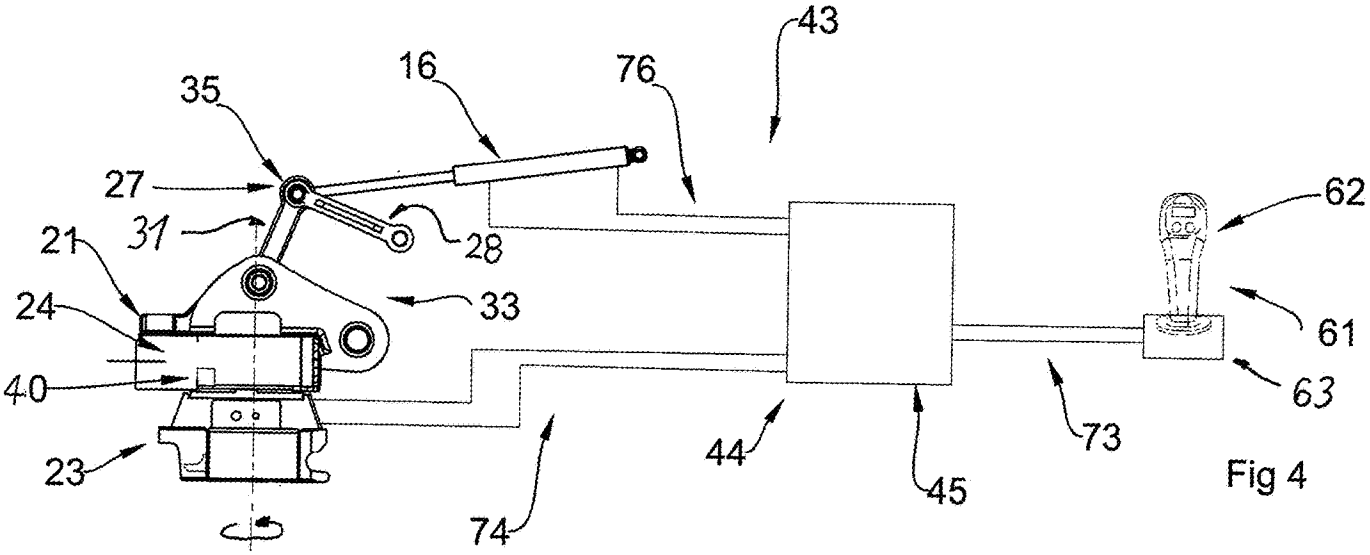
Figure 5:
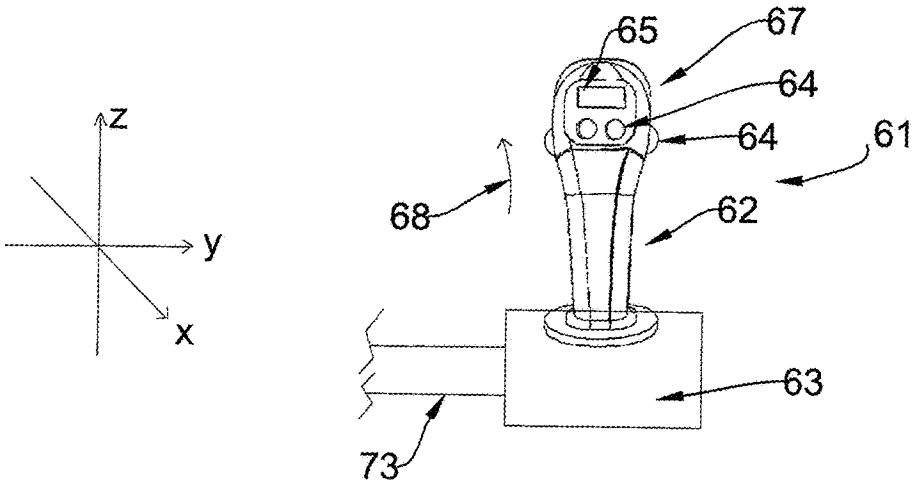
Figure 6:
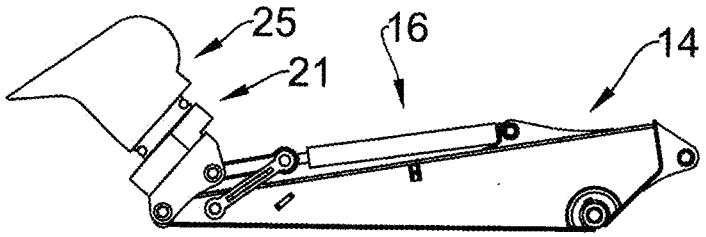
Figure 7:
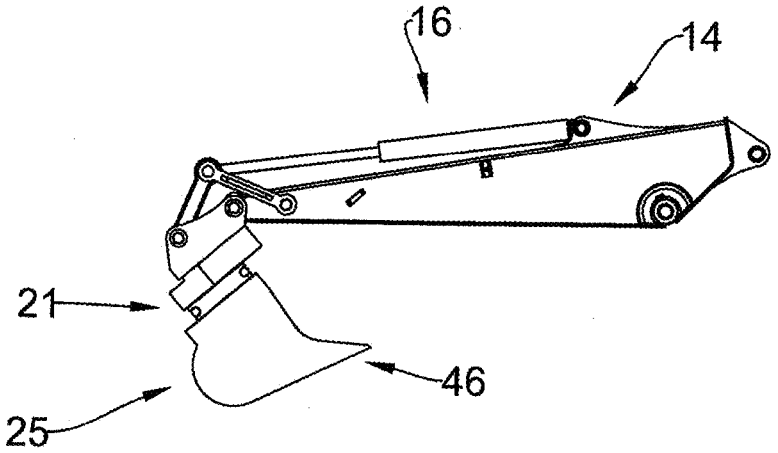
Figure 8:
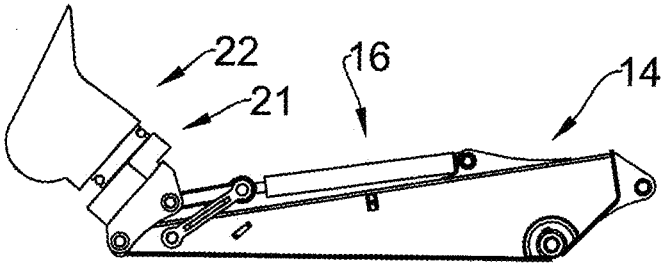
Figure 9:
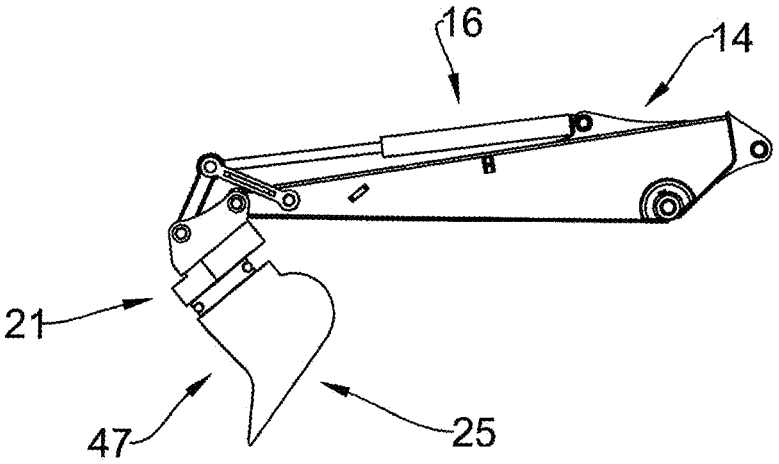

The invention and other advantageous embodiments and further embodiments thereof are described and explained in more detail below with reference to the examples shown in the drawings. The features to be taken from the description and the drawings can be used individually or in any combination in accordance with the invention. It shows:

FIG. 1 a schematic side view of an excavator with a working device,

FIG. 2 a perspective view of an attachment device for connecting to a stick of the excavator for holding the working device as shown in FIG. 1, FIG. 3 a schematic side view of the attachment device according to FIG. 2, FIG. 4 a schematic view of a control system for the excavator shown in FIG. 1, FIG. 5 a perspective view of a one-hand operating device for the control unit according to FIG. 4, FIG. 6 a schematic side view of the stick with the attachment as a backhoe bucket in a first working position, FIG. 7 a schematic view of the backhoe bucket according to FIG. 6 in a second working position, FIG. 8 a schematic view of the handle with the working device as an elevation bucket in a first working position, and FIG. 9 a schematic side view of the elevating bucket according to FIG. 8 in a further working position.

FIG. 1 shows a schematic side view of an excavator 11. The excavator 11 comprises a basic machine 13 with a boom 12, which is hinged together at the end with a stick 14. The boom 12 is moved up and down by a lifting cylinder 19. The boom 12 comprises at least one stick cylinder 18 for actuating a pivoting movement of the stick 14. A pressure cylinder 16 is provided on the stick 14, at least, by means of which an attachment device 21 provided on the stick 14 can be actuated. The attachment device 21 is pivotably mounted at the end of the stick 14 in a mounting axis 17.

This attachment device 21 can comprise a rotary device 22 with a rotary drive 24 and a coupling, in particular a quick-change device 23. The rotary device 22 comprises a drive housing 66. The quick-change device 23 can be rotated relative to the drive housing 66 along an axis of rotation 26 by the rotary drive 24. A working device 25 is interchangeably provided on the quick-change device 23. The quick-change device 23 has a first changer half 41, which is provided on the working device side, and a second changer half 42, which is provided on the rotary drive 24. The second changer half 42 comprises at least one controllable latch 56. After positioning a latch receiver 59 on the first latch bolt 55 of the first changer half 41, the latch 56 can engage behind the second latch bolt 55 of the first changer half 41 and connect and lock the first and second changer halves 41, 42. Such a quick-change device is known, for example, from DE 20 2021 101 016 U1.

Swivel kinematics 27 are provided to control a swivel movement of the attachment device 21. This comprises a deflector 28, which is articulated at one end to the handle 14 on a deflector axis 29. Furthermore, the swivel kinematics 27 comprises a coupler 31, which is connected at one end to the deflector 28 via a common swivel axis 35. At the opposite end, the coupling 31 engages with a coupling device 33. This coupling device 33 is a component of the attachment device 21 or is mounted on the attachment device 21. Preferably, the drive housing 66 has a cover surface extending at least in sections, on which the coupling device 33 is provided. The pressure cylinder 16, in particular a piston rod of the pressure cylinder 16, engages on the swivel axis 35 of the swivel kinematics 27.

FIG. 2 shows a perspective view of the attachment device 21. FIG. 3 shows a schematic side view of this attachment device 21 as shown in FIG. 2.

The coupling device 33 comprises two cheeks 36 arranged at a distance from one another. The cheeks 36 can be connected to at least one connecting plate 34, which extends between the cheeks 36. The at least one connecting plate 34 can rest against an upper side of the rotating device 22 and preferably be detachably fastened thereto. Each cheek 36 comprises a coupling bearing point 37 and a mounting bearing point 38. The coupling bearing point 37 and the mounting bearing point 38 are arranged offset in height relative to one another. The add-on storage location 38 is recessed relative to the coupling storage location 37. The attachment bearing point 38 can also be offset in the direction of a plane of rotation 39 of the rotary device 22 or lie in this plane of rotation 39. The attachment bearing point 38 is offset laterally outwards relative to the attachment device 21, in particular the rotary device 22, or is assigned to an end face of the rotary device 22.

The rotating device 22 also comprises a rotary feed-through 71, through which hydraulic lines can be fed through the rotating device 22 in order to be coupled to a working device 25. In this way, for example, a shear, a gripper or another drive such as a vibrator drive or the like can be controlled.

The quick-change device 23, on which the attachment 25 is interchangeably mounted, enables a rotary movement around the axis of rotation 26 by controlling the rotary device 22. This rotary movement can cover 360°. The axis of rotation 26 is preferably aligned perpendicular to the mounting axis 17. The detection of a positioning and/or an alignment of the working device 25 arranged on the quick-change device 23 relative to the attachment device 21, in particular the drive housing 66 of the attachment device 21, is advantageously carried out by at least one angle detection device 40, which is provided on or in the attachment device 21. This angle detection device 40 communicates with the control circuit 44 of a control unit 43, which is explained in more detail below in FIG. 4.

To detect an alignment of the working device 25 to the attachment device 21, the maximum rotation range of 360° around the rotation axis 26 is divided into a first working range 46 and a second working range 47. The first and second working ranges 46, 47 are preferably formed identically with respect to the respective angular circumference. In particular, they each comprise a range of rotation of 180°. A dividing line 48, in particular a fictitious dividing line, is thus formed between the first and second working areas 46, 47. This fictitious dividing line 48 lies in the mounting axis 17 or is offset parallel thereto and preferably aligned perpendicular to the axis of rotation 26. Advantageously, the first working area 46 extends from a point 51, which corresponds to a three o'clock position, for example, via a point 52, which corresponds to a six o'clock position, for example, to a point 53, which corresponds to a nine o'clock position. The second working area 47 starts, for example, from point 53, i.e. the nine o'clock position, and extends via a point 54, for example, a twelve o'clock position, to point 51, which represents the three o'clock position.

The orientation of the working device 25 is assigned to the first or second working area 46, 47 by the angle detection device 30 depending on the detected rotational position relative to the dividing line 48.

FIG. 4 schematically shows the control unit 43 for the excavator 11. This control system 43 comprises a control circuit 44 and a one-hand operating device 61, which can be used to control the working device 25. On the operator side, the control circuit 44 comprises a first control circuit 73 between a control block 45 and the one-hand operating device 61. On the drive side, a second control circuit 74 is provided between the control block 45 and the attachment device 21. Furthermore, a third control circuit 76 is provided between the control block 45 and the pressure cylinder 16. The first control circuit 73 is preferably designed as a hydraulic circuit that operates with a pilot pressure or pilot control pressure. For example, at least one control valve is actuated by the one-hand operating device 61 when a handle 62 is deflected from an initial position 67 into an actuating position, whereby a pilot pressure acts on the control block 45.

Alternatively, it may be provided that the first control circuit 73 is also designed as an electrical control circuit. For example, a deflection of the handle 62 from an initial position 67 in an actuating direction 68 is detected by electrical sensors and corresponding signals are transmitted to the control block 45. The control unit 43 can also have a wireless design in order to communicate with the integrated components.

The signals supplied to the control block 45 by the operator are converted and forwarded depending on the configuration of the second and third control circuits 74, 76. It may be provided, that the control block 45 actuates the pressure cylinder 16 via a hydraulic circuit to control a swivel movement of the attachment device 21 about the mounting axis 17. It can also be provided that the control block 45 controls the rotary drive 24 of the attachment device 21 via the second control circuit 74, which is designed as a hydraulic circuit. In this case, the rotary drive 24 comprises a hydraulic motor. Alternatively, electrical control of the rotary drive 24 can be provided instead of the hydraulic circuit if an electric motor is used.

If the first and second control circuits 73, 74 or the first and third control circuits 73, 76 or all control circuits 73, 74, 76 are designed as hydraulic circuits, the operating pressures of the second and/or third control circuits 74, 76 are higher than a pilot pressure in the first control circuit 73.

FIG. 5 shows the one-hand operating device 61 in perspective and enlarged. The handle 62 is provided on a console 63 so as to be movable, preferably pivotable and/or tiltable, by at least one degree of freedom. This console 63 is connected to the first control circuit 73. One or more operating elements 64 may be provided on the handle 62. These may be buttons, rockers, lockable pushbuttons and/or switches. In addition, a display 65 can also be provided on the handle 62 to show the operator individual symbols to indicate the operating mode or operating status.

The handle 62 can preferably be deflected from its starting position 67 or a neutral position in an actuating direction 68, for example in the Y-direction. When actuating such an actuating direction 68, for example, a pivoting movement of the attachment device 21 from a first working position shown in FIG. 6 to a further working position of the working device 25 shown in FIG. 7 can be actuated. In this embodiment, the working device 25 is aligned with the second working area 47. In this case, a digging movement of the working device 25, which is preferably used as a backhoe bucket, is controlled by the actuating direction 68.

FIG. 8 shows a schematic side view of the handle according to FIG. 6 with an working device 25 arranged thereon. In the embodiment according to FIG. 8, the working device 25 is rotated by 180° relative to the arrangement in FIGS. 6 and 7. The working device is aligned with the first working area 46. The working device 25 is used as a backhoe bucket for digging.

If the handle 62 is actuated in the actuating direction 68 when the working device 25 is aligned as shown in FIG. 8, this would result in the working device 25 being actuated and pivoted for a digging movement as in the embodiment shown in FIGS. 6 and 7, but without enabling digging. However, this changed orientation of the working device 25 in the first working area 46 according to FIG. 8 compared to that in FIG. 6 is now detected by the angle detection device 30 and at least one corresponding signal is forwarded to the control circuit 44. Advantageously, a change in the actuation direction of the third control circuit 76 takes place in the control block 45, so that with a constant actuation direction 68 of the handle 62, a pivoting movement of the attachment device 21 and thus a working movement of the working device 25 is actuated starting from FIG. 9 to FIG. 8. In this case, the control of the swivel movement of the attachment device 21 is thus rotated by 180°. This in turn enables digging of the working device 25 when aligned with the second first working area 46.

If the operator of the excavator 11 controls a rotary movement of the working device 25 with the rotary drive 24, the current position and orientation of the working device 25 is detected by the angle detection device 30 and passed on to the control circuit 44. When the orientation of the working device 25 changes from the first working area 46 to the second working area 47 or vice versa, the control circuit 44 automatically changes the activation of the third control circuit 76 so that a reversed working movement of the working device 25 is activated while the actuating direction 68 of the handle 62 remains the same.

The invention claimed is:

1. Control system for an excavator for actuating a working device, with a one-hand operating device, which comprises a handle which is moveable by at least one degree of freedom and/or has at least one operating element, with a control circuit which is controllable by the one-hand operating device, wherein the working device is connectable to an attachment device and the attachment device comprises a rotary drive which controls the a rotary movement of the working device about an axis of rotation of the attachment device, wherein the control circuit controls at least one rotary movement of the working device as a function of its actuation by the handle, and wherein the control circuit controls a pivoting movement of the attachment device about an mounting axis about which the attachment device is pivotably mounted on the a stick, wherein at least one angle detection device, which communicates with the control circuit, is provided for detecting an angular position of the working device relative to the attachment device, which is actuated by the rotary movement of the working device about the axis of rotation by the rotary drive and in the event of a change in the orientation of the working device by the rotary movement about the axis of rotation from a first working range into a second working range or vice versa, which is detectable by the angle detection device, a change in the actuation of the pivoting direction of the attachment device is actuatable by the control circuit with the same actuation direction of the handle.

2. Control system according to claim 1, wherein the first working range and the second working areas range together extend over a circumference of 360°.

3. Control system according to claim 1, wherein the first working range and the second operating ranges working range extend over an equal angular range have an angular range and wherein the angular range of the first working range and the second working range are equal.

4. Control system according to claim 1, wherein a dividing line is formed between the first and second working areas, which and wherein the dividing line lies in the mounting axis or is offset parallel to the mounting axis of the mounting device.

5. Control system according to claim 1, wherein the control circuit comprises a control block from which the rotary drive for the rotary movement of the working device is controllable hydraulically or electrically.

6. Control system according to claim 5, wherein the control block of the control circuit hydraulically or electrically controls at least one working cylinder for controlling the pivoting movement of the attachment device about the mounting axis.

7. Control system according to claim 5, wherein the control block of the control circuit is controllable hydraulically or electrically by the one-hand operating device.

8. Control system according to claim 7, wherein the one-hand operating device and the control block are connected to a first hydraulic control circuit which operates with a pilot pressure.

9. Control system according to claim 1, wherein the working device designed as a bucket is useable as a high bucket during alignment in the first working area and as a low bucket during alignment in the second working area.

10. Control system according to claim 6, wherein during the rotary movement of the working device about the axis of rotation, a change from the first working area to the second working area or from the second working area to the first working area is detectable by the angle detection device and an automatic switch in the actuation of the control circuit for actuating the pressure cylinder is activatable by the control block.

11. Control system according to claim 1, wherein the at least one angle detection device is designed as an angle encoder or an incremental encoder.

12. Control system according to claim 3, wherein the first working range and the second working range extend over an equal angular range and each comprising an angular range of 180°.

13. Control system according to claim 4, wherein the dividing line is a fictitious dividing line.

* * * * *